US009717293B2

(12) United States Patent
Lim

(10) Patent No.: US 9,717,293 B2
(45) Date of Patent: Aug. 1, 2017

(54) MAGNETIC FASTENER FOR A GARMENT

(71) Applicant: Michelle P. Lim, New York, NY (US)

(72) Inventor: Michelle P. Lim, New York, NY (US)

( * ) Notice: Subject to any disclaimer, the term of this patent is extended or adjusted under 35 U.S.C. 154(b) by 0 days.

(21) Appl. No.: 15/175,487

(22) Filed: Jun. 7, 2016

(65) Prior Publication Data

US 2016/0360810 A1 Dec. 15, 2016

Related U.S. Application Data

(63) Continuation of application No. 62/174,029, filed on Jun. 11, 2015.

(51) Int. Cl.
*A41F 1/00* (2006.01)
*A44B 1/14* (2006.01)

(52) U.S. Cl.
CPC ..... *A41F 1/002* (2013.01); *A44B 1/14* (2013.01)

(58) Field of Classification Search
CPC ..... A41F 1/002; A44B 1/14
See application file for complete search history.

(56) References Cited

U.S. PATENT DOCUMENTS 2,615,227 A 10/1952 Hornik
3,535,747 A 10/1970 Benn
4,231,137 A 11/1980 Fujimoto
4,453,294 A 6/1984 Morita
4,528,726 A 7/1985 Kurashima
4,736,494 A 4/1988 Marchesi
4,924,559 A 5/1990 Marchesi
5,974,634 A 11/1999 Eisenpresser
6,226,842 B1 5/2001 Wong
6,622,349 B2 9/2003 Wong
7,065,841 B2 * 6/2006 Sjoquist ..... A41F 1/002 24/303
7,992,264 B2 * 8/2011 Abadi ..... A41F 1/002 24/3.13
8,062,315 B2 11/2011 Aster et al.
8,231,581 B2 7/2012 Tanaka
8,506,577 B2 8/2013 Tanaka et al.
8,516,665 B2 8/2013 Clarke et al.
8,667,650 B1 3/2014 Duffin
8,752,252 B2 6/2014 Ninomiya et al.
8,936,222 B1 1/2015 Bastian et al.
9,131,739 B1 * 9/2015 Sjoquist ..... A41F 1/002
D744,900 S 12/2015 Tang
2003/0154576 A1 8/2003 Mirharooni
2006/0096070 A1 5/2006 Ishida
2006/0236509 A1 * 10/2006 Ausman ..... A44B 5/02 24/303
2007/0028367 A1 2/2007 Allen
2007/0028429 A1 2/2007 Ishida
2007/0245460 A1 10/2007 Ryan et al.
(Continued)

*Primary Examiner* — David Upchurch
(74) *Attorney, Agent, or Firm* — Pearl Cohen Zedek Latzer Baratz LLP

(57) ABSTRACT

A magnetic fastener is provided that permits existing garment buttons to be retrofitted for use by persons having diminished motor abilities. The magnetic button system comprises a button cover received over an existing button and having a magnet housed therein. The magnet is attracted to a magnetic or ferromagnetic element on a button hole engagement member received in a button hole of an existing garment.

13 Claims, 14 Drawing Sheets

(56) References Cited

U.S. PATENT DOCUMENTS

| | | | | |
|---|---|---|---|---|
| 2008/0047111 | A1* | 2/2008 | Garber ..... | A44C 5/2061<br>24/303 |
| 2008/0287973 | A1 | 11/2008 | Aster et al. | |
| 2010/0242230 | A1 | 9/2010 | Cohen | |
| 2010/0263173 | A1 | 10/2010 | Clarke et al. | |
| 2011/0277502 | A1 | 11/2011 | Welikson | |
| 2014/0130228 | A1 | 5/2014 | Horton | |
| 2015/0250269 | A1 | 9/2015 | Tang | |

* cited by examiner

Section C-C

MAGNETIC FASTENER FOR A GARMENT

CROSS REFERENCE TO RELATED APPLICATIONS

This application claims the benefit of U.S. Provisional Patent Application, No. 62/174,029, filed Jun. 11, 2015, which is incorporated by reference in its entirety.

BACKGROUND OF THE INVENTION

Field of the Invention

The invention is directed to a magnetic fastener which allows an existing shirt to be retrofitted for ease of use by those with diminished motor abilities in the hands caused by severe arthritis, stroke, Parkinson's disease, or other condition.

People with diminished motor abilities in the hands due to stroke, Parkinson's disease, or other condition, often lose their ability to button a shirt, vest or jacket. An object of the invention is to a provide magnetic button system that can be fitted over existing buttons on a garment, so that a user may fasten and unfasten the buttons, without requiring significant manual dexterity and without requiring repurposing of the garment.

Description of the Prior Art

Use of magnetic closures is widespread in the garment industry. U.S. Patent Application Publication US 2014/0130228, for example, describes a shirt or vest with magnets embedded in the plackets of the garment. Button covers are known, which may use magnets to attach ornamentation to a button, as disclosed in U.S. Patent Application Publications US 2015/0250269 and US 2011/0277502, for example Magnetic cufflink closures for conventional French cuff shirts are disclosed for example in U.S. Pat. Nos. 2,483,031 and 4,528,726, and in U.S. Patent Application Publication US 2003/0154576. U.S. Pat. No. 8,667,650 describes magnetic cufflinks adapted for use with button cuffs.

There remains a need in the art for a magnetic button system that is relatively easy to install on a variety of existing garments with buttons, including shirt fronts and vests, which can be detached and installed on different items of clothing, and which affords persons with diminished motor ability the freedom to retrofit a wardrobe so that they can dress themselves.

SUMMARY OF THE INVENTION

These and other objects of the invention are achieved according to one aspect of the invention with a magnetic button system comprising two cooperating components: a button hole engagement member (also referred to as the "front piece") and a button cover. The button hole engagement member is adapted to be engaged in a button hole of a garment, comprising a backing portion, a post, and a facing portion. The backing portion comprises a recess having a magnetic or ferromagnetic element therein. The button cover comprises a housing adapted to enclose a button attached to the garment and also enclose a permanent magnet. The button cover may take a variety of forms, but in all cases the button cover comprises a space for receiving a permanent magnet, an opening to receive a button on an existing garment, and an aperture adapted to receive the button threads attached to the garment so that the button cover may be applied without removing the button. When installed, the button cover is received in the recess of the backing portion over the magnetic or ferromagnetic element in the button hole engagement member. The magnet enclosed in the housing of the button cover exerts magnetic force on the magnetic or ferromagnetic element in the recess of the backing portion sufficient to attach the button hole engagement member to the button cover, generally with a pull force greater than 2 lbs.

The invention is also a method of retrofitting a garment for use by persons with diminished motor skills, comprising the steps of installing a plurality of magnetic fasteners as described above on a plurality of buttons on an existing garment. In embodiments the retrofitted buttons include most or all of the buttons on a shirt front or vest front.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Dimensions herein are provided for illustration only and do not limit the invention. However, existing garment button hole and button sizes are near-standard on many shirts, and dimensions suitable for use with these standard buttons may be provided as illustrative examples. Unless the context clearly requires otherwise, when dimensions or other values are modified by the word "about", this refers to a variation of no more than ±20%. Likewise, "substantially", "substantially all" and similar variations, means no less than 90%, unless the context clearly requires otherwise.

The magnetic fastener of the invention comprises a button cover and a button hole engagement member attached by magnetic force. The two components together may be referred herein to as an "apparatus", a "magnetic button system", or simply a "fastener".

Figure 1:
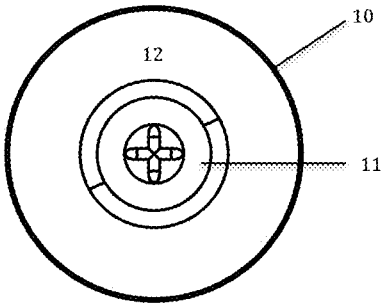
FIG. 1 is a front elevation of a button hole engagement member according to an embodiment of the invention.
Figure 2:
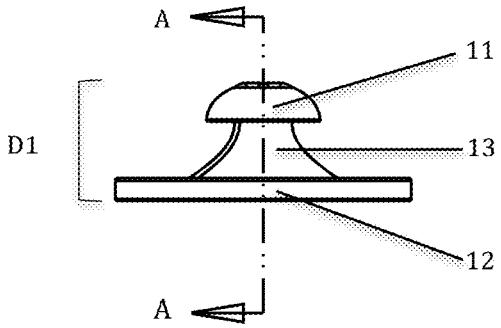
FIG. 2 is a side view of the button hole engagement member of FIG. 1.

FIG. 1 depicts an embodiment of button hole engagement member 10 (also referred to herein as the "front piece") which includes button portion 11 and backing portion 12 connected by post 13, which is shown in the side view of FIG. 2. When button hole engagement member 10 is inserted into a button hole of a shirt front, for example, button portion 11 and backing portion 12 are on opposite sides of the shirt placket. Button (or "facing") portion 11 faces frontward and is visible, having the appearance of a button, or other ornamental design, left to the choice of the designer. For example, where the system is used with a typical man's shirt, button portion 11 must be able to slide through the button hole and may mimic the size and appearance of a button, having a diameter of about 10 mm. This also ensures that button portion 11 is large enough not to slip through the button hole too once button hole engagement member 10 engages the button hole. Backing portion 12 is also large enough not to slip through a button hole; but is also preferably larger than button portion 11 to assist in engaging button cover 20 in FIG. 4 with magnetic force, as described below. In embodiments, the rear of backing portion 12 is a circle having a diameter of about 26 mm. Post 13, shown in the side view of FIG. 2, has a width conveniently secured in a button hole. Certain embodiments according to the invention include a taper on post 13 which may result in less movement of engagement member 10 in the button hole. In embodiments, the height of the front piece, D1 in FIG. 2, may be about 8 mm to about 12 mm.

Figure 3:
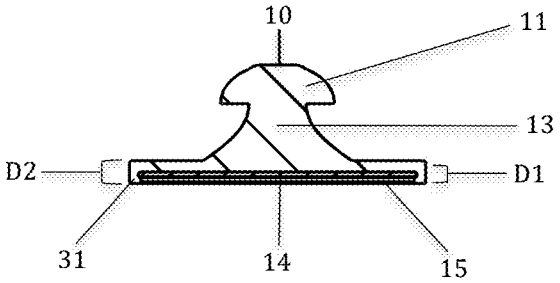
FIG. 3 is a cross sectional view of the button hole engagement member along lines A-A in FIG. 2.

The cross sectional view of FIG. 3 shows recess 15 receiving a magnetic or ferromagnetic member 14. In embodiments, the magnetic or ferromagnetic member 14 may be a metal disk, and may be coated with an oxidation layer or lamination to prevent corrosion. The ferromagnetic member preferably covers a large area facing the button cover and forms a layer to facilitate magnetic attraction and interlocking of button cover 10 in the recess 15. The ferromagnetic member may also be completely encapsulated in button hole engagement member 10, which may enable the device to be made waterproof. In embodiments, the entire area of recess 15 and substantially all of the rear surface is covered by a thin ferromagnetic disk. In one embodiment, shown in FIG. 3, member 14 is a metal disk, about 0.25 to about 2.0 mm thick, and if a magnet is used may be about 1 to 3 mm. However, in other embodiments, the member 14 may be a permanent magnet and may have different dimensions.

In the embodiment shown, edge 31 on the rear periphery of button hole engagement member 10 forms a bezel adapted to engage disk 14. Peripheral rear edge 31 of the button hole engaging member may also serve to guide button cover 20 (shown in FIG. 4) to the closed position and mate with button cover in the closed position. This mating engagement results in a tactile sensation of the button being closed when it is attached to the front piece by magnetic force, which may have advantages for those with reduced motor ability.

Figure 4:
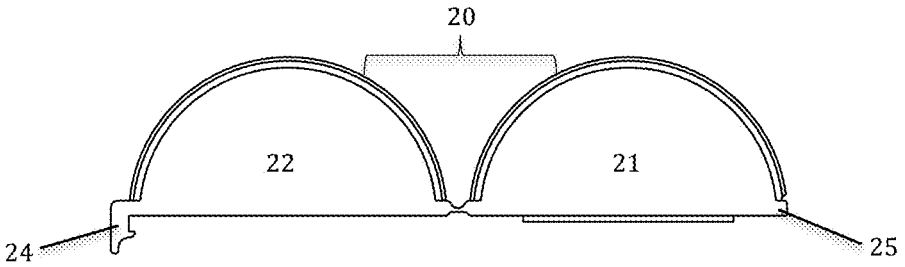
FIG. 4 is a front elevation of a button cover according to an embodiment of the invention.

FIG. 4 depicts button cover 20 which encloses a permanent magnet according to one embodiment of the invention. Button cover 20 has an opening that receives the button attached to an existing garment. Button cover 20 may completely encapsulate the magnet(s) so that the device may be made waterproof.

Figure 5:
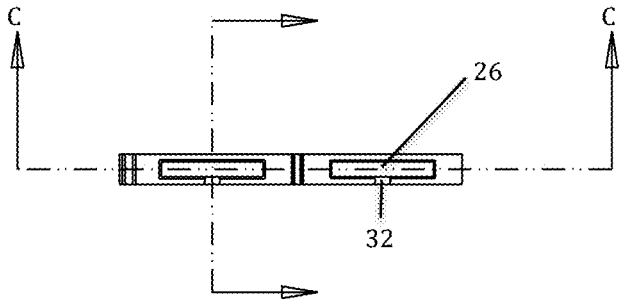
FIG. 5 is a side view of the button cover of FIG. 4, showing the interior space where a button is received.
Figure 6:
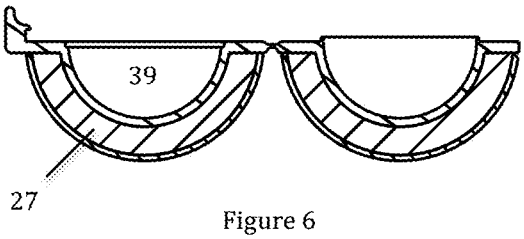
FIG. 6 is a cross sectional view of the button cover element along lines C-C of FIG. 5.
Figure 7A:
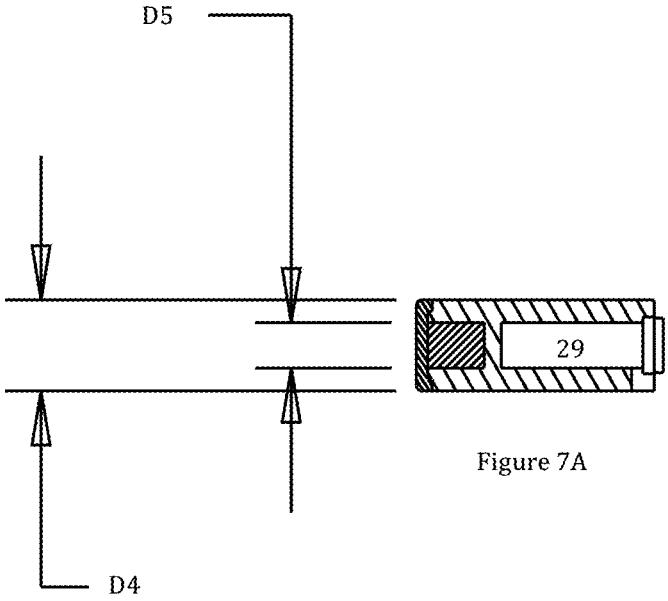
FIGS. 7A and 7B depict cross sectional details of an exemplary latch closure of the button cover.
Figure 7B:
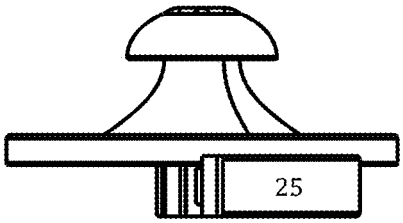

In the embodiment shown in FIG. 4, button cover 20 comprises two semi-circular halves 21, 22 joined by a hinge. For this purpose, polycarbonate or other polyester, or other resin may be used, known in the art to be used for like fittings. In embodiments a metal fitting, or a fitting having metal in it, may be used. Semicircular button cover halves 21, 22 include an opening 26 (shown in FIG. 5) in a side surface which is completely closed when the button on the existing garment is enclosed therein. The halves are joined by a latch closure 24, 25 in the closed state. FIG. 6 is a cross sectional view of the button cover element along lines C-C of FIG. 5, showing opening 26 (as in FIG. 5) where a button on an existing garment is received. FIG. 6 is a side view of the button cover of FIG. 4, showing the interior space 39 where a button is received. Aperture 32 in FIG. 5 is formed on a rear surface of button cover 10 to accommodate button threads attaching the existing button to the garment.

Figure 9:
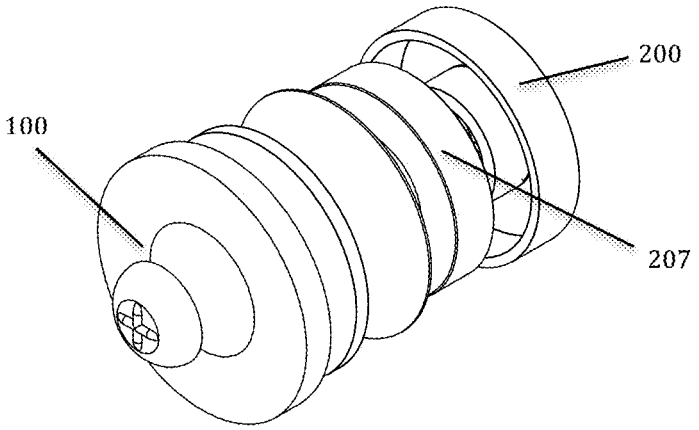
FIG. 9 is an exploded view of a magnetic button system according to another embodiment of the invention.
Figure 10:
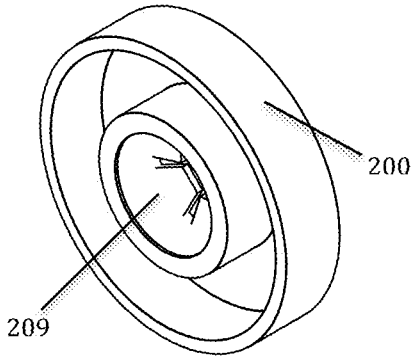
FIG. 10 is a perspective view of a button cover according to the embodiment of FIG. 9.
Figure 11:
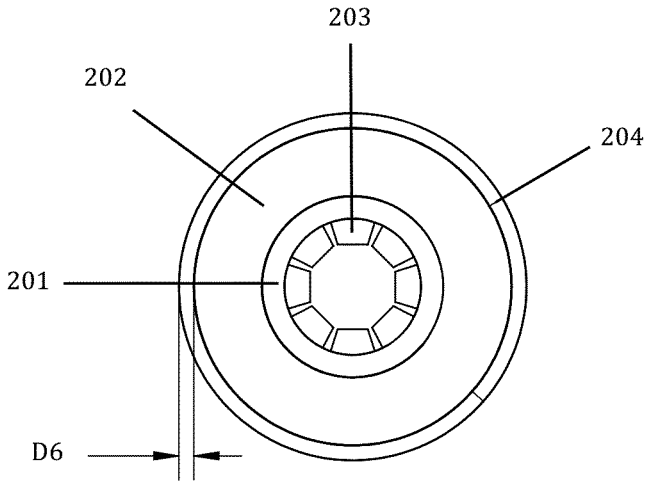
FIG. 11 is an elevation of the button cover shown in FIG. 10.
Figure 12:
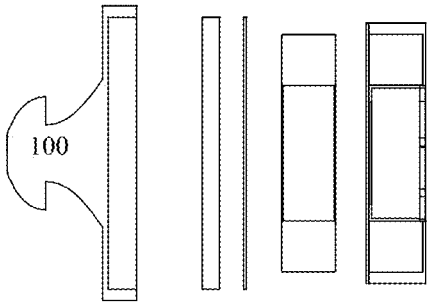
FIG. 12 is a side exploded view showing the assembly of the button cover shown in FIG. 9 with a magnetic button system according to an embodiment of the invention.

In an alternative embodiment shown in FIG. 9, FIG. 10 and FIG. 11, button cover 200 in FIG. 10 comprises a central opening 209 in a rear surface thereof for receiving a button on an existing garment. One or more flexible members 203 in FIG. 11 on a periphery of opening 209 in FIG. 10 are adapted to flex and ride over the button and grip the button when button cover 200 encloses the button. Annular space 202, defined between wall 201 around opening 209 (shown in FIG. 10) and wall 204 on the periphery of the button cover, houses one or more permanent magnets 207 in FIG. 9 which applies a magnetic force on button hole engagement member 100 in FIG. 9. The thickness dimension D6 of wall 204 is about 1 mm in the embodiment shown, and wall 201 may have a similar dimension, but these dimensions are not critical.

Figure 8A:
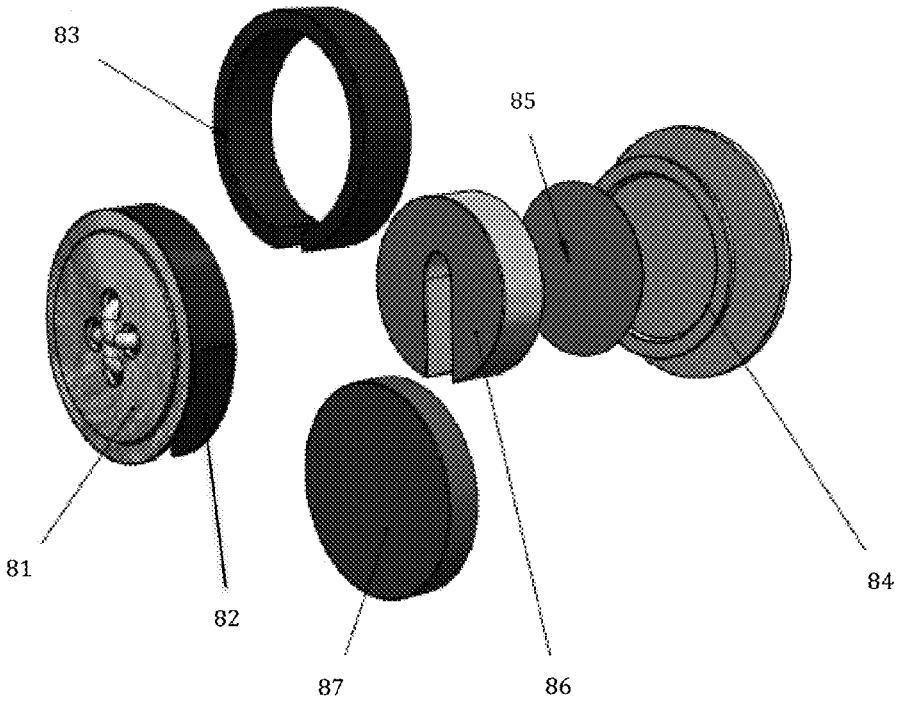
FIGS. 8A and 8B are exploded views of a magnetic button system according to another embodiment of the invention.
Figure 8B:
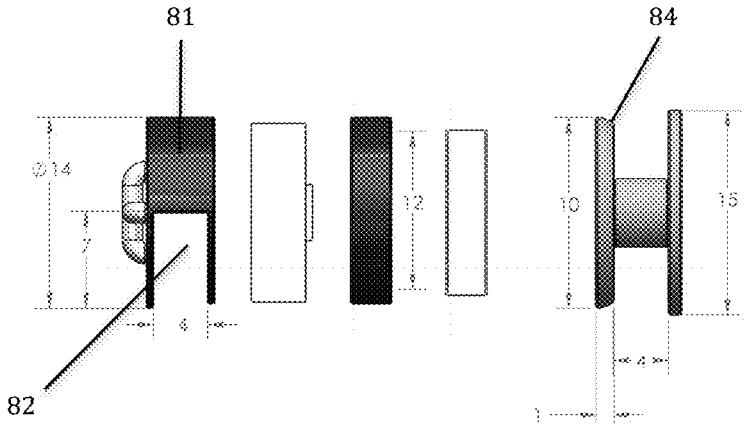

In an embodiment shown in FIG. 8A and FIG. 8B, opening 82 is provided on the side of the button cover 81, and front and back magnets 85, 86 are provided to apply force between button cover 81 and button hole engagement member 84. Spacer 83 secures button cover 81 to an existing button 87.

In the embodiment of FIG. 6, the permanent magnet comprises two annular neodymium magnets 27 arranged around cavity 39, where the existing garment button is received. The neodymium magnets, with the dimensions shown, and provided a ferromagnetic disk as shown, are sufficient to provide a pulling force of 2 lbs or greater.

The method of using the magnetic button system described above to retrofit a shirt, vest or other garment for use by a person with reduced motor ability involves simply installing a button cover as described above so that it encloses a button attached to an existing garment and so that a surface area of the enclosed magnet faces frontward. The user slides a button hole engagement member as described above through a buttonhole corresponding to the button cover. The button cover and front piece are engaged by magnetic force, and in preferred embodiment, proper placement is ensured by a recess on the front piece receiving the button cover. Preferably, a plurality of existing buttons on a shirt or vest front is retrofitted in this way, so that the most challenging aspects of dressing are made easier.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention. Further, the embodiments disclosed herein are related, so that features and dependent limitations disclosed in the specification in connection with one embodiment or one independent claim may also be combined with another embodiment or another independent claim, without departing from the scope of the invention.

What is claimed is:

1. A magnetic fastener, comprising a button hole engagement member adapted to be engaged in a button hole of a garment, comprising a backing portion, a post, and a facing portion; wherein the backing portion comprises a recess having a magnetic or ferromagnetic element therein; and a button cover having an aperture adapted to receive button threads attached to a garment and a housing adapted to enclose a magnet and a button attached to the garment; and wherein the button cover is received in the recess of the backing portion over the magnetic or ferromagnetic element; and wherein the magnet enclosed in the housing of the button cover exerts magnetic force on the magnetic or ferromagnetic element in the recess of the backing portion sufficient to attach the button hole engagement member to the button cover, wherein the button cover comprises two semi-circular halves joined by a hinge.

2. The magnetic fastener according to claim 1, wherein the button cover mates with a bezel formed by a rear peripheral edge of the backing portion.

3. The magnetic fastener according to claim 1, wherein the button cover encloses a pair of annular permanent magnets.

4. The magnetic fastener according to claim 1, wherein the button cover completely encapsulates the magnet.

5. The magnetic fastener according to claim 3, wherein the magnets are neodymium.

6. The magnetic fastener according to claim 5, wherein the neodymium magnets exert a pulling force of at least about 2 lbs on the button hole engagement member.

7. The magnetic fastener according to claim 1, wherein the magnetic or ferromagnetic element is a disk of ferromagnetic metal received in a bezel in the backing portion of the button hole engagement member and covering substantially the entirety of a rear surface of the backing portion of the button hole engagement member.

8. The magnetic fastener according to claim 1, wherein the backing portion, post and facing portion of the button hole engagement member are formed of a single integral piece of resin or metal.

9. The magnetic fastener according to claim 1 wherein the ferromagnetic member is completely encapsulated within the button hole engagement member.

10. A method for retrofitting buttons of an existing garment with a plurality of magnetic fasteners according to claim 1, comprising the steps of:

enclosing a plurality of buttons attached to an existing garment inside a respective plurality of button covers of said magnetic fasteners according to claim 1;

inserting a plurality of button hole engagement members of said magnetic fasteners according to claim 1 into respective button holes of the existing garment, corresponding to the respective buttons on the existing garment; wherein each magnet exerts a pull force of at least about 2 lbs on the respective button hole engagement member.

11. The method according to claim 10, wherein the magnetic or ferromagnetic element is a disk of ferromagnetic metal received in a bezel in the backing portion of the button hole engagement member and covering substantially the entirety of a rear surface of the backing portion, and the button cover mates with the bezel in the backing portion.

12. The magnetic fastener according to claim 11, wherein the backing portion, post and facing portion of the button hole engagement member are formed of a single integral piece of resin or metal, and wherein the button cover comprises two semi-circular halves made of resin or metal joined by a hinge, each of the semi-circular halves having an opening in a side thereof to receive the button on the existing garment.

13. The method according to claim 10, wherein the garment is a men's shirt and the plurality of buttons on the existing garment are buttons on a shirt front, each having a diameter of about 10 to about 13 mm.

* * * * *